United States Patent [19]

Jones et al.

[11] Patent Number: 5,067,650

[45] Date of Patent: Nov. 26, 1991

[54] MAILBOX PROTECTOR

[76] Inventors: Mark G. Jones, Rte. 6, Box 49B, Paris, Tex. 75460; Tommy T. Wright, Rte. 2, Box 306, Center, Tex. 75935

[21] Appl. No.: 610,407

[22] Filed: Nov. 7, 1990

[51] Int. Cl.[5] ..... B65D 91/00

[52] U.S. Cl. ..... 232/17; 232/38

[58] Field of Search ..... 232/17, 38; D99/29, D99/31

[56] References Cited

U.S. PATENT DOCUMENTS

| | | | |
|---|---|---|---|
| 4,368,842 | 1/1983 | DeLange, III | 232/17 |
| 4,375,869 | 3/1983 | Hatch | 232/17 |
| 4,712,731 | 12/1987 | Gramelspacher | 232/17 |
| 4,792,088 | 12/1988 | Bonnell | 232/17 |
| 4,905,892 | 3/1990 | Fischer | 232/17 |

*Primary Examiner*—Robert W. Gibson, Jr.

*Attorney, Agent, or Firm*—Ross, Howison, Clapp & Korn

[57] ABSTRACT

A mailbox protector comprising a deformable cover adapted to be attached to at least the upwardly facing surface of a mailbox; a reservoir inside the cover adapted to confine a liquid, non-toxic dye; and ports adapted for expelling dye from the reservoir upon the application of a crushing blow to the cover.

7 Claims, 2 Drawing Sheets

MAILBOX PROTECTOR

TECHNICAL FIELD

This invention relates to protective coverings for mailboxes, and more particularly, to a protective covering specially adapted to deter destruction of mailboxes by vandalism.

BACKGROUND OF THE INVENTION

Property owners have recently experienced increasing instances of vandalism involving the intentional destruction of mailboxes. This destruction is frequently accomplished by crushing in the tops of such mailboxes with baseball bats, pipe sections, wet mops, and the like. Oftentimes the perpetrators vandalize mailboxes by crushing them while leaning out the windows of motor vehicles.

Although mailbox protectors comprising protective cages made of materials such as wood or steel have previously been used to thwart such vandalism, the prior art mailbox protectors are relatively expensive and oftentimes unattractive. Furthermore, the conventional mailbox protectors previously known do not provide any means for identifying the vandals who attack the mailboxes.

Prior art devices for protecting mailboxes are disclosed, for example, in U.S. Pat. Nos. 3,107,848; 4,368,842; 3,375,869; 4,813,595; and Des. 305,824.

SUMMARY OF THE INVENTION

According to the present invention, a mailbox protector is provided that is relatively inexpensive and that can be easily secured or attached to existing mailboxes with little effort.

According to a preferred embodiment of the invention, the subject mailbox comprises a double-walled plastic cover member adapted to conform to the top and, if desired, sides of a conventional mailbox, a void or reservoir within the cover member that is adapted to receive and maintain a non-toxic, preferably liquid dye, and means in the forwardly facing end wall of the cover member for permitting the dye to be expelled outwardly from the reservoir inside the cover member whenever the cover member is subjected to a crushing blow.

According to a particularly preferred embodiment of the invention, the edges of the cover member that are to be adjacent to the sides of the mailbox are provided with an adhesive material covered by a releasable strip that is removed just prior to installing the mailbox protector on the mailbox.

BRIEF DESCRIPTION OF DRAWINGS

The apparatus of the invention is further described and explained in relation to the following drawings in which.

Like reference numerals are used to indicate like parts in all figures of the drawings.

DETAILED DESCRIPTION OF THE INVENTION

Figure 1:
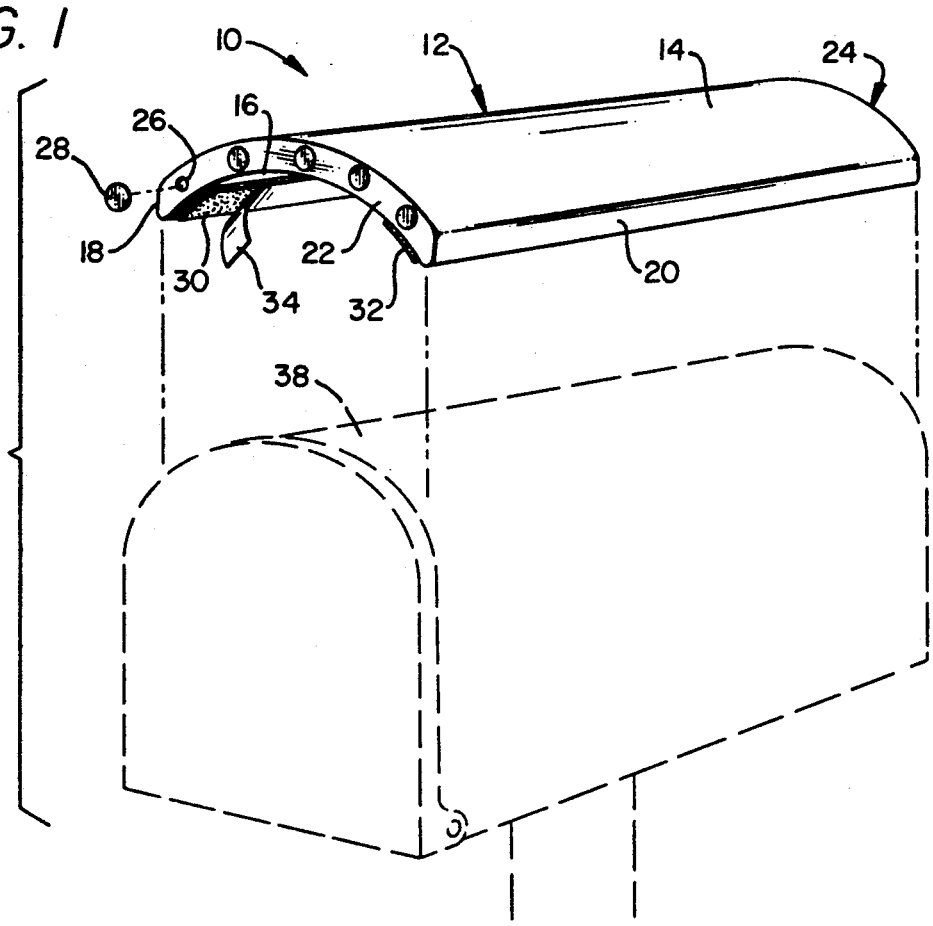
FIG. 1 is an exploded perspective view depicting the mailbox protector of the invention as it would be positionally aligned over the top of a conventional mailbox (shown in phantom)
Figure 2:
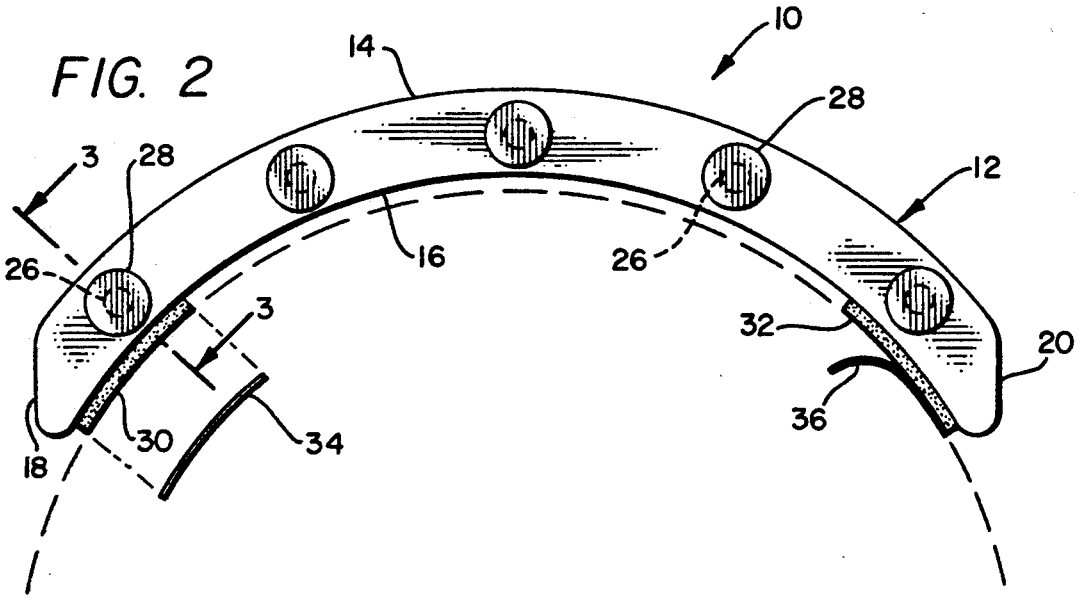
FIG. 2 is a front elevation view depicting the mailbox protector of FIG. 1 as installed on a conventional mailbox (shown in phantom)

Referring to FIGS. 1 and 2, mailbox protector 10 preferably comprises cover member 12 having top and bottom arcuate surfaces 14, 16, integrally molded sidewalls 18, 20, and front and rear end walls 22, 24.

Cover member 12 of mailbox protector 10 is preferably molded from a polymeric material such as, for example, polypropylene, which may contain other additives such as plasticizers, antioxidants, ultraviolet light stabilizers, and the like, commercially known in the plastics molding industry for prolonging the useful life of plastic products used outdoors.

The curvature of arcuate top and bottom surfaces 14, 16, respectively, is preferably adapted to conform to the upwardly facing outside surface of a conventional mailbox.

As shown in FIGS. 1 and 2, cover member 14 is primarily adapted to cover the top surface of the mailbox. It will be appreciated, however, upon reading this disclosure that cover member 12 can be similarly molded with sides that extend downward adjacent to each side of a conventional mailbox as well. Where a flag is present on the side of the mailbox, a slot can be provided that will accommodate the flag.

As part of mailbox protector 10, means are preferably provided for securing or attaching cover member 12 to the mailbox with which it is to be used. As shown in the drawings, cover member 12 is provided with adhesive strips 30, 32 extending longitudinally down that portion of lower arcuate surface 16 that is adjacent side walls 18, 20, respectively. Conventional, commercially available, pressure sensitive adhesive strips can be used satisfactorily for this purpose. As shown in FIGS. 1 and 2, paper tape 34 is peeled away from adhesive strip 30 at the use site just prior to attaching mailbox protector 10 to mailbox 38.

Figure 3:
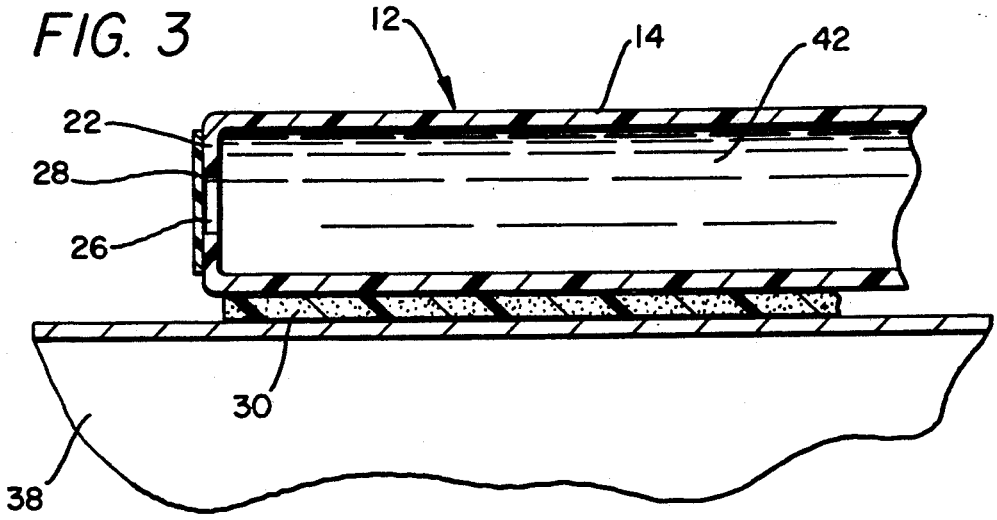
FIG. 3 is an enlarged detail sectional elevation view taken along line 3—3 of FIG. 2.
Figure 4:
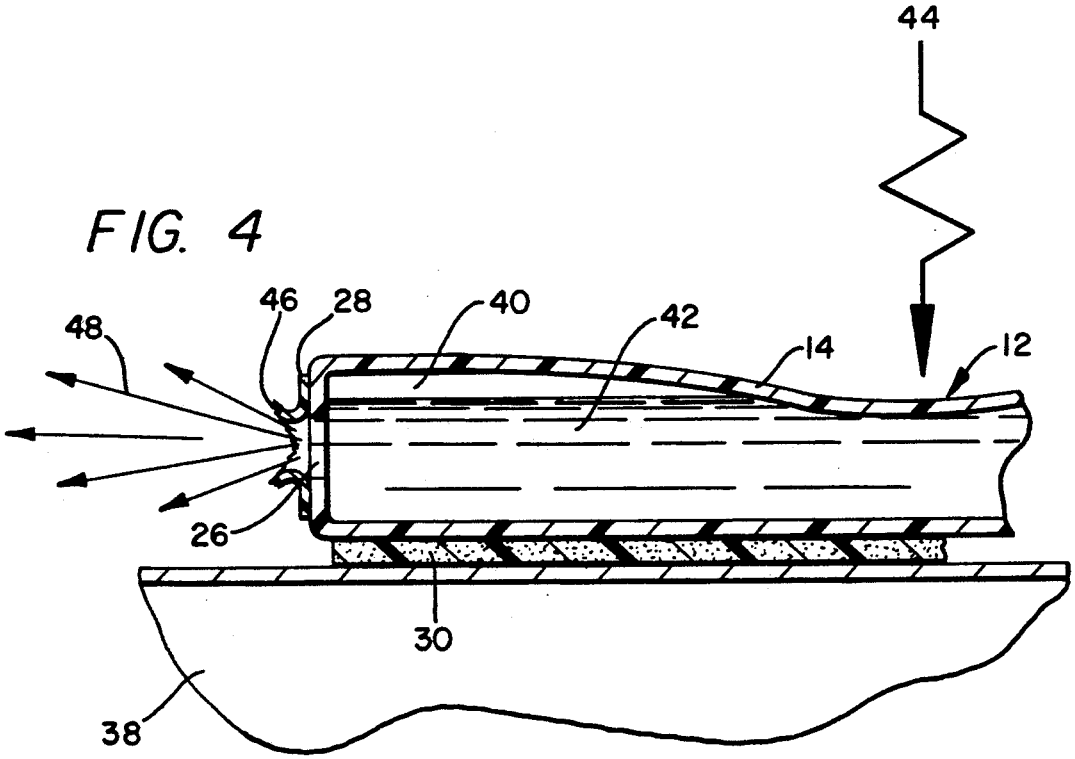
FIG. 4 depicts the structure of FIG. 3 after a crushing blow is applied to the subject mailbox protector, causing the non-toxic dye inside the cover member to be expelled outwardly through an aperture in the forwardly facing end wall of the cover member.

Cover member 12 is preferably constructed in such manner that surfaces 14, 16, edges 18, 20 and end walls 22, 24 cooperate to define an enclosed void or reservoir 40 adapted to receive and confine a quantity of liquid, non-toxic dye 42 as shown in FIGS. 3 and 4. Such dyes are well known and are commercially available. The use of permanent (non-water soluble) dyes is preferred where it is desired to mark the person or vehicle of the perpetrator for purposes of subsequent identification by police or postal authorities.

Referring to FIGS. 1–4, a plurality of apertures are preferably provided in spaced-apart relation across forwardly facing end wall 22 of cover member 12. If desired, apertures 26 can be used for injecting dye 42 into reservoir 40. After reservoir 40 of cover member 12 is filled with dye 42, means such as polymeric membranes 28 are desirably secured by use of adhesives, heat sealing, or the like, over apertures 26 to confine dye 42 within reservoir 40. Polymeric membranes 28 are preferably adapted to rupture upon the application of a crushing blow to top surface 14 of cover member 12, thereby causing top surface 14 to deform and causing dye 42 to be expelled through rupture 46 in polymeric membrane 28 as depicted by arrows 48 in FIG. 4.

Alternatively, if faster filling of reservoir 40 is desired, after membranes 28 are secured to end wall 22 over apertures 26, dye 42 can be injected into reservoir cover member 12 through another site, which can then be sealed by any satisfactory means to avoid unintended leakage. If such a method for filling cover method 12 with dye is utilized, the means for sealing any opening in cover member 12 other than apertures 26 should be able to withstand pressures greater than can be withstood by membranes 28 without rupturing.

Referring to FIGS. 3 and 4, upon the application of a crushing blow to top surface 14 of cover member 12, the pressure exerted against membrane 28 by dye 42 through apertures 26 will desirably be sufficient to cause membrane 28 to rupture. For this reason, the rupture strength of membrane 28 should be less than the rupture strength of the remainder of the material used in making cover member 12. Similarly, the means used to attach membrane 28 to end wall 22 should be strong enough to withstand pressures greater than the pressure required to rupture membrane 28.

When constructed as disclosed herein, mailbox protector 10 will desirably cause a spray of permanent dye to fan outwardly from the front of mailbox 38, hopefully marking the person or automobile of any vandal who inflicts a destructive blow against mailbox 38.

While a cover member 12 having double wall construction is disclosed herein as the preferred embodiment of applicant's invention, it will be understood and appreciated upon reading this disclosure that a similarly effective mailbox protector can be made by constructing a cover member having a separate internal bladder, the inside of which is in fluid communication with apertures 26. Such a configuration is also understood to be within the scope of the invention.

Other alterations and modifications of the invention will become apparent to those of ordinary skill in the art upon reading the present disclosure, and it is intended that the scope of the invention be limited only by the broadest interpretation of the appended claims to which the inventor is legally entitled.

We claim:

1. A mailbox protector comprising a cover member adapted to be attached to a mailbox, a reservoir within the cover member, a non-toxic dye within the reservoir, and means for expelling the dye from the reservoir whenever a crushing blow is applied to the cover member.

2. The mailbox protector of claim 1 wherein the cover member is molded from a thermoplastic material.

3. The mailbox protector of claim 2 wherein the cover member is molded to conform to the upwardly facing, outside surface of a mailbox.

4. The mailbox protector of claim 1, further comprising means for attaching the cover member to a mailbox.

5. The mailbox protector of claim 1 wherein the cover member comprises an end wall, and the forwardly facing end wall further comprises a plurality of spaced-apart apertures.

6. The mailbox protector of claim 5 wherein the apertures are covered by a membrane having a rupture strength less than that of any other portion of the cover member.

7. The mailbox protector of claim 1 wherein pressure sensitive adhesive strips are provided for attaching the cover member to a mailbox.

* * * * *